US009816419B2

(12) United States Patent
Schorn et al.

(10) Patent No.: US 9,816,419 B2
(45) Date of Patent: Nov. 14, 2017

(54) CONICAL HONEYCOMB BODY HAVING CHANNELS EXTENDING RADIALLY OUTWARD AT AN ANGLE AND HONEYCOMB BODY ASSEMBLY

(71) Applicant: EMITEC GESELLSCHAFT FUER EMISSIONSTECHNOLOGIE MBH, Lohmar (DE)

(72) Inventors: Christian Schorn, Lohmar (DE); Sigrid Limbeck, Much (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 14/556,595

(22) Filed: Dec. 1, 2014

(65) Prior Publication Data

US 2015/0086804 A1 Mar. 26, 2015

Related U.S. Application Data

(63) Continuation of application No. PCT/EP2013/060269, filed on May 17, 2013.

(30) Foreign Application Priority Data

Jun. 1, 2012 (DE) ..... 10 2012 104 767

(51) Int. Cl.
*F01N 3/28* (2006.01)

(52) U.S. Cl.
CPC ..... *F01N 3/281* (2013.01); *F01N 3/2814* (2013.01); *F01N 2230/02* (2013.01); (Continued)

(58) Field of Classification Search
None
See application file for complete search history.

(56) References Cited

U.S. PATENT DOCUMENTS 2,041,889 A * 5/1936 Wheeler ..... F16J 15/20 156/189
5,318,757 A * 6/1994 Abe ..... B01D 53/945 422/173

(Continued)

FOREIGN PATENT DOCUMENTS

CN 1403691 A 3/2003
CN 1539053 A 10/2004

(Continued)

OTHER PUBLICATIONS

English Translation of FR 2617903 dated Mar. 31, 2016.*

*Primary Examiner* — Adam Krupicka
(74) *Attorney, Agent, or Firm* — Laurence A. Greenberg; Werner H. Stemer; Ralph E. Locher

(57) ABSTRACT

A honeycomb body includes wound and/or stacked layers having a geometric center axis, a cavity rotationally symmetrically around the center axis and an outer lateral surface. Each layer extends approximately concentrically around the axis. At least one of the layers is at least partially structured forming channels through which a fluid can flow. The channels extend from the cavity outward to the outer lateral surface at a non-right cone angle to the axis. The channels have a cross-section changing along the channels from inside to outside. At least one structured layer and at least one intermediate layer are alternatingly disposed and helically layered. The structure height of the structured sheet-metal layer forming the channels is substantially constant and channel cross-sectional areas increase from inside to outside. The intermediate layer can be made of simple wires or of specially cut or folded smooth sheet-metal layers.

12 Claims, 9 Drawing Sheets

(52) U.S. Cl.
CPC ..... *F01N 2230/04* (2013.01); *F01N 2330/02* (2013.01); *F01N 2330/04* (2013.01); *F01N 2330/32* (2013.01); *F01N 2330/321* (2013.01); *F01N 2330/324* (2013.01); *Y10T 428/1234* (2015.01)

(56) References Cited

U.S. PATENT DOCUMENTS

| | | | |
|---|---|---|---|
| 5,506,028 | A | 4/1996 | Brück |
| 5,645,803 | A | 7/1997 | Steenackers et al. |
| 7,473,288 | B2 | 1/2009 | Toyoda et al. |
| 8,075,978 | B2 | 12/2011 | Zaldua-Moreno et al. |
| 8,147,763 | B2 | 4/2012 | Maus |
| 2008/0148945 | A1 | 6/2008 | Wieres et al. |

FOREIGN PATENT DOCUMENTS

| | | | |
|---|---|---|---|
| CN | 1629458 | A | 6/2005 |
| CN | 201963375 | U | 9/2011 |
| DE | 10235691 | A1 | 2/2004 |
| EP | 0676534 | A1 | 10/1995 |
| EP | 0894949 | A2 | 2/1999 |
| FR | 2617903 | A1 | 1/1989 |
| FR | 2622632 | A1 | 5/1989 |
| JP | H06107474 | A | 4/1994 |
| JP | H0880422 | A | 3/1996 |
| JP | 2010013944 | A | 1/2010 |
| RU | 2413575 | C2 | 3/2011 |

* cited by examiner

CONICAL HONEYCOMB BODY HAVING CHANNELS EXTENDING RADIALLY OUTWARD AT AN ANGLE AND HONEYCOMB BODY ASSEMBLY

CROSS-REFERENCE TO RELATED APPLICATION

This is a continuation, under 35 U.S.C. §120, of copending International Application No. PCT/EP2013/060269, filed May 17, 2013, which designated the United States; this application also claims the priority, under 35 U.S.C. §119, of German Patent Application DE 10 2012 104 767.7, filed Jun. 1, 2012; the prior applications are herewith incorporated by reference in their entirety.

BACKGROUND OF THE INVENTION

Field of the Invention

The present invention relates to a honeycomb body wound and/or stacked from layers, such as is used, in particular, for gas purification. In the case of exhaust-gas purification systems, in particular for internal combustion engines of motor vehicles, use is made of honeycomb bodies which are coated with catalytically active material and/or are configured especially for separating off particles, wherein metallic materials are often used for the honeycomb bodies. The invention also relates to a honeycomb body assembly.

Specifically in motor vehicle applications, consideration must be given to a variety of boundary conditions. Firstly, the space available for the installation of exhaust-gas purification systems is limited, and secondly, the systems should not generate an excessive pressure loss in the exhaust system, because that has an adverse effect on the efficiency of internal combustion engines.

Numerous configurations of wound or layered honeycomb bodies are already known from the prior art, including configurations with channels running axially in a flow direction, configurations with channels running radially outward from an inner cavity to a collecting chamber, and also conical honeycomb bodies in which channels that widen in cross section run from one side face to an opposite side face.

Numerous different configurations are also described in European Patent Application EP 0 676 534 A1 corresponding to U.S. Pat. No. 5,645,803, including configurations with channels that run obliquely radially outward. German Patent Application DE 102 35 691 A1 also describes such a profile of channels.

SUMMARY OF THE INVENTION

It is accordingly an object of the invention to provide a conical honeycomb body having channels extending radially outward at an angle and a honeycomb body assembly, which overcome the hereinafore-mentioned disadvantages of the heretofore-known honeycomb bodies and assemblies of this general type and which can be easily produced, in particular in a mass production context, and/or can be adapted to different space conditions during installation. The honeycomb body should also permit constructions which provide relatively large surface areas for exhaust-gas purification with relatively low pressure losses.

With the foregoing and other objects in view there is provided, in accordance with the invention, a honeycomb body, comprising wound or stacked layers, a geometric central axis, a cavity disposed rotationally symmetrically around the central axis and an outer lateral surface, wherein each layer runs (approximately) concentrically around the central axis, at least one of the layers is at least partially structured in such a way that the layers form a multiplicity of channels through which a fluid can flow, the channels run outwardly from the cavity to the outer lateral surface with a non-perpendicular cone angle with respect to the central axis, and the channels have a channel cross section which varies over the course of the channels from the inside to the outside. It is also proposed that the at least one structured layer be disposed in alternation with at least one intermediate layer, wherein the two layers are stacked one on top of the other in helical fashion.

In this case, the channels do not run exactly radially from the inside to the outside, that is to say they do not run perpendicularly or at right angles to the central axis, but instead run at a (different) angle relative thereto. This reduces the pressure losses in comparison to exactly radially running channels, because the twofold diversion of the fluid is less intense. In this configuration, the individual layers have approximately the shape of a funnel and in this case a helical construction is used, in particular, in such a way that the layers do not have a closed form but run similarly to a spiral staircase, but with a non-perpendicular angle with respect to the central axis. This configuration according to the invention offers, in particular in combination with other configurations, additional flexibility for the utilization of existing structural space and for the reduction of pressure losses.

In particular, in order to also permit relatively simple manufacture, it is provided that at least one structured layer be disposed in alternation with at least one inter-mediate layer, wherein the two layers are stacked one on top of the other in helical fashion. The intermediate layer serves substantially to maintain the spacing between the structured layers, in such a way that the latter cannot slide by way of their structures into one another.

A main problem with regard to the production of such honeycomb bodies resides in constructing the individual layers in such a way that they can be brought into the desired helical shape and have the desired structural characteristics. Since metal sheets typically used for such honeycomb bodies are supplied as long straight strips wound in so-called coils, suitable deformation is required, but such deformation must not go beyond limits defined by the material.

In accordance with another preferred exemplary feature of the invention, the cavity and/or the lateral surface have a cylindrical form or shape. For manufacturing-related reasons alone, this configuration is preferable because all of the structured layers can be of the same form.

In accordance with a further feature of the invention, a cone angle with respect to the central axis of 25° to 85°, preferably 40° to 70°, is proposed, wherein an angle of approximately 45° is particularly suitable for many applications.

In accordance with an added feature of the invention, the structured layers are formed in such a way that the structure height, which forms the channels, of the structured sheet-metal layer is (substantially) constant and the channel cross-sectional areas increase from the inside to the outside. Due to the constant structure height, the profile of successive layers in the honeycomb body remains approximately parallel, which is not the case, for example, in the case of conical honeycomb bodies with channels of increasing cross-sectional area running from one side face to the other.

In accordance with an additional feature of the invention, a constant structure height can be obtained, in particular, by virtue of the structured sheet-metal layer having a structure which, in interaction with adjacent intermediate layers, forms channels having a perimeter or boundary wall which is formed by a flank corrugation of the structured sheet-metal layer and has (substantially) the same length at all locations but the channel cross-sectional area of which increases from the inside to the outside with an approximately constant structure height. This means, in particular, that the flank corrugation has quite an intense curvature, that is to say runs in very narrow corrugations, at the inside, whereas the flank corrugation becomes progressively more drawn-out or broadened in the outer region, in such a way that the associated channel cross-sectional area becomes ever larger. Such corrugated forms or shapes can be produced, for example, using known machines for the corrugation of sheet-metal layers, and subsequently drawing one side out and/or subsequently compressing the other side.

In accordance with yet another feature of the invention, if similar layers are used for the entire honeycomb body, a form is produced in which the cavity is disposed so as to be axially offset relative to the lateral surface, in such a way that the honeycomb body has a first, conical side face and a second, hollow conical side face. This form is expedient from a flow aspect and, in particular, permits a combination with other honeycomb bodies in order to utilize existing free spaces.

In accordance with yet a further feature of the invention, since the production of helically running, continuous, smooth sheet-metal plies would possibly require very intense deformation, it is proposed, in one exemplary embodiment of the invention, that all of the layers be of structured form, specifically with structured sheet-metal layers with a coarse structure and intermediate layers with a fine structure in alternation, wherein the dimensions of the coarse and fine structures differ by at least a factor of 3, preferably by a factor of 5 to 10. Through the use of different dimensions in the structure, it is achieved that the coarse structure substantially gives rise to the shape of the channels, whereas the fine structure of the intermediate layers serves (predominantly only) to prevent the coarse structures from sliding into one another. In this way, it is thus possible for two helically shaped, differently structured layers to be stacked one on top of the other to form a highly uniform honeycomb body.

In accordance with yet an added feature of the invention, the intermediate layers have slots which are formed inward along the profile of the channels proceeding from the outer lateral surface, and which preferably run inward from the outer lateral surface and widen in an outward direction. In this way, an intermediate layer is formed which is coherent at the inside and which can prevent the structured sheet-metal layers from sliding into one another even though the slots are still open to the outside.

In accordance with yet an additional feature of the invention, as another option which, however, is associated with loss of material during production, the intermediate layer is provided with triangular cutouts which are dimensioned in such a way that the intermediate layer, after being bent into its helical final shape, forms an approximately closed intermediate layer again. In this way, it is possible, without intense deformation, to realize the desired helical form of the intermediate layer and further-more reliably prevent the structured adjacent sheet-metal layers from sliding into one another.

In accordance with again another feature of the invention, which is a further variant in terms of manufacturing, the intermediate layer is folded along fold lines in such a way that overlaps with (at least) threefold material thickness are generated and an (approximately) helical profile of the intermediate layer is formed. In this case, no cutting tools are required and no waste is produced, but due to the overlaps, a part of the surfaces can no longer be utilized for making contact with a fluid flowing through. Nevertheless, this configuration is highly expedient for continuous production, and the overlaps produced do not pose a problem in terms of production with the thin metal sheets that are typically used.

In accordance with again a further feature of the invention, a wire or multiple wires are laid as an intermediate layer, the wires running in helical fashion between the structured sheet-metal layers, preferably in inlay grooves pre-formed in the structured sheet-metal layers. The inlay grooves may be jointly produced directly during the shaping of the structured sheet-metal layers, and in general, just two wires running spaced apart from one another are sufficient to reliably prevent the structured sheet-metal layers from sliding into one another. Depending on the type of structures, even one wire may suffice, although in the case of large honeycomb bodies, three or more wires are advantageous.

In this case, for the structured sheet-metal layers, preferably for all of the layers used in the honeycomb body, use is made of high temperature corrosion-resistant materials, in particular of steels that include chromium and/or aluminum and/or nickel. Such materials are well proven for high temperatures, in particular in exhaust systems of motor vehicles. They can furthermore be connected to one another by established brazing techniques, in particular by high-temperature vacuum brazing. This connecting technique is also used, in particular for the honeycomb bodies according to the invention, at the contact points between the layers in order to stabilize the body.

In the case of honeycomb bodies that are used for separating off particles, in particular soot particles, it is advantageous for at least some of the layers to be formed from porous material, preferably from a porous metallic material, in particular from metal fiber material and/or sintered material. Such materials improve the separation of soot particles and permit flow guidance whereby at least a part of the flow runs within the porous material.

The described honeycomb bodies are preferably used as catalyst carrier or substrate bodies, that is to say they are provided with a catalytically active coating which promotes the conversion of pollutants in an exhaust gas.

With the objects of the invention in view, there is concomitantly provided a honeycomb body assembly, comprising a cylindrical honeycomb body through which a fluid can flow along a geometric central axis, and a honeycomb body according to the invention combined with the cylindrical honeycomb body. In addition, a common housing may be provided in which the honeycomb bodies are disposed with the geometric central axes aligned.

The configurations of a honeycomb body described herein do not require the cavity to be closed at one end, so that all of the exhaust gas supplied to the cavity flows obliquely outward through the honeycomb body. It is possible for the cavity to be constructed to be open at both sides, and for a further honeycomb body, in particular a cylindrical honeycomb body through which a flow can pass axially, to be disposed in combination with the honeycomb body according to the invention, in particular in a common housing and with aligned geometric central axes. In this way, an available structural space can be utilized particularly effectively, and lower pressure losses are generated than in the case of conventional configurations. This advantage also applies to other configurations of honeycomb bodies with a geometric central axis and with a cavity disposed rotationally symmetrically around the central axis and with an outer lateral surface, wherein a multiplicity of channels through which a fluid can flow are provided, which channels run outward from the cavity to the outer lateral surface with a non-perpendicular cone angle with respect to the central axis. Such honeycomb bodies, some of which will also be described in more detail on the basis of the drawing, may generally advantageously be combined with a cylindrical honeycomb body through which a flow can pass axially, in particular in a common housing and with aligned geometric central axes. In this case, the outlet of the cavity of a honeycomb body with obliquely outwardly running channels forms a type of inlet cone for a subsequent cylindrical honeycomb body with channels running parallel to the central axis. This results in low pressure losses at the transition between the two honeycomb bodies. Overall, it is thus possible to form a combination of two honeycomb bodies which is advantageous from thermal and flow aspects.

In a preferred use, the described honeycomb body or the described honeycomb body configuration or assembly is part of an exhaust-gas treatment system, preferably of an internal combustion engine, in particular of a motor vehicle.

Exemplary embodiments and the field of the invention will be described in more detail below on the basis of the drawings. The invention is not restricted to these exemplary embodiments; rather, features described on the basis of different figures may be combined with one another in an expedient fashion. It is pointed out that some of the structures and production methods described on the basis of the drawings are also suitable for the mass production of honeycomb bodies with channels running exactly radially outward, that is to say with channels that run outward perpendicularly to a geometric central axis. Some of the figures show such structures for illustrative purposes, even though the present invention is directed to obliquely running channels and substantially funnel-shaped layers. The illustrations shown, however, likewise contain important concepts for the production of exactly radial channels in honeycomb bodies that are the subject of other inventions.

Other features which are considered as characteristic for the invention are set forth in the appended claims, noting that advantageous embodiments that may be used individually or in technologically expedient combinations with one another are recited in the dependent claims. The description, in particular in conjunction with the figures explains the invention and specifies further embodiments of the invention.

Although the invention is illustrated and described herein as embodied in a conical honeycomb body having channels extending radially outward at an angle and a honeycomb body assembly it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
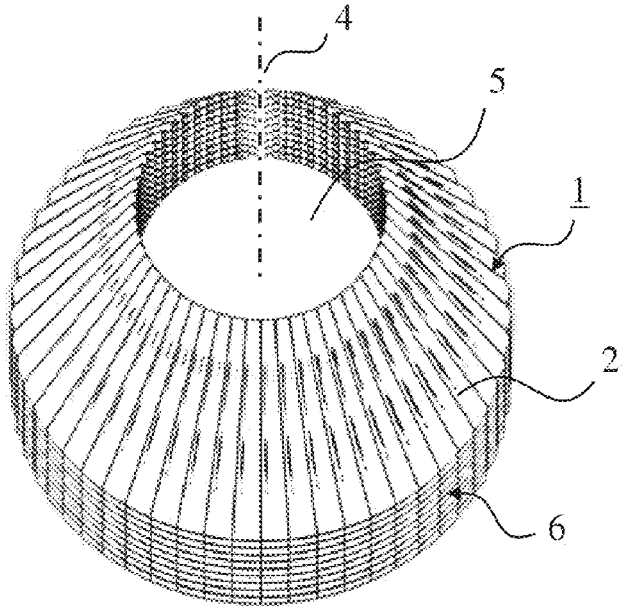
FIG. 1 is a diagrammatic, perspective view of a honeycomb body with channels running obliquely from the inside to the outside.

Referring now to the figures of the drawings in detail and first, particularly, to FIG. 1 thereof, there is seen a diagrammatic illustration of a basic construction of an exemplary embodiment of a honeycomb body 1 according to the invention with structured sheet-metal layers 2 as a major constituent part, in which the structured sheet-metal layers extend approximately concentrically around a geometric central axis 4 and each individually approximately have the shape of a funnel. A cylindrical cavity 5 is situated in the interior of the honeycomb body. The structured sheet-metal layers 2 are delimited at the outside by an outer lateral surface or jacket surface 6.

Figure 2:
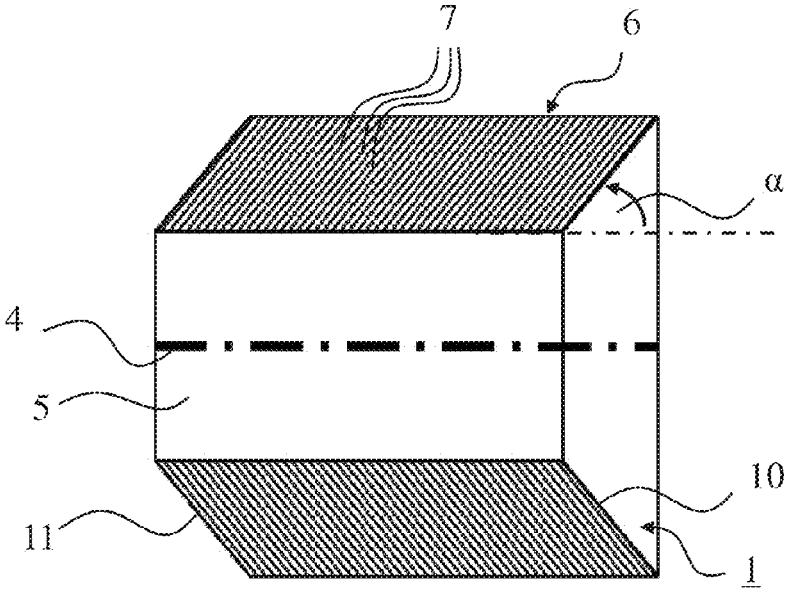
FIG. 2 is a longitudinal-sectional view through the geometric central axis of FIG. 1.

FIG. 2 shows a diagrammatic longitudinal section through the geometric central axis 4 of FIG. 1. In this case, it can be seen that numerous channels 7 lead obliquely outward from the cavity 5, specifically with a cone angle a with respect to the direction of the geometric central axis 4, wherein all of the channels end at the outer lateral surface 6. In this way, a conical side face 11 and a hollow conical side face 10 are formed.

FIG. 3 shows, once again in a diagrammatic illustration, a perspective view of a single structured sheet-metal layer 2, which extends in funnel-shaped form around the cavity 5. In this case, it is also possible to see the particular channel shape selected in this exemplary embodiment, which is shown in more detail in FIG. 4.

Figure 4:
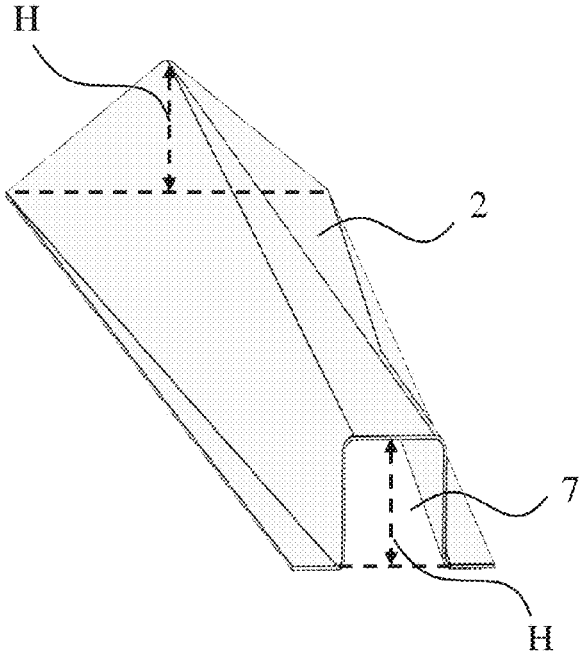
FIG. 4 is a perspective view of a first exemplary embodiment of channel forms of the structured sheet-metal layer.

FIG. 4 illustrates the general geometric problem in forming, from substantially planar sheet-metal strips, structures which have the same structure height H over the entire width of the sheet-metal strip but, despite the same amount of material being used around the perimeter, have a smaller cross section at one end than at the other end, thus rendering it possible to produce the desired funnel shape of the structured sheet-metal layer 2. The channels 7 of the structured sheet-metal layer 2 that are formed have a channel cross-sectional area 7*i*, 7*a* (see FIG. 6) that increases in the outward direction.

Figure 5:
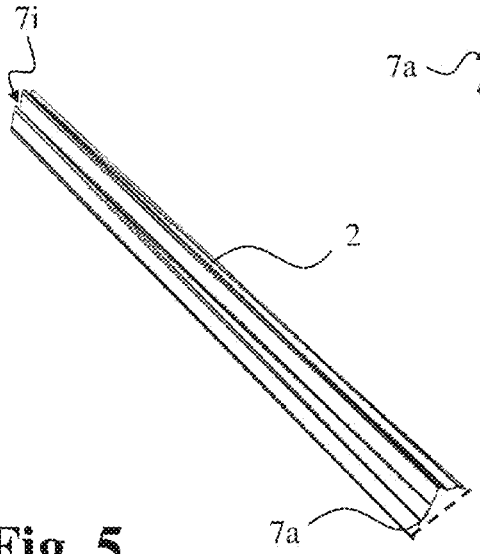
FIGS. 5, 6, 7 and 8 are perspective views illustrating further exemplary embodiments of channel forms of the structured sheet-metal layer.
Figure 6:
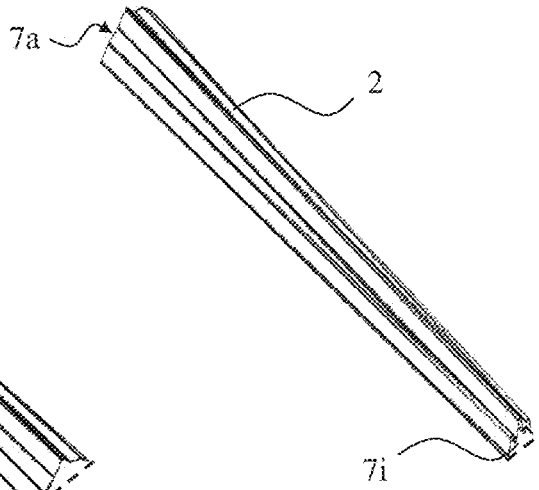
Figure 7:
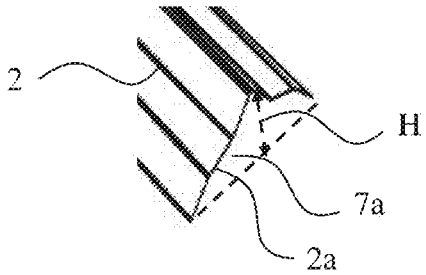
Figure 8:
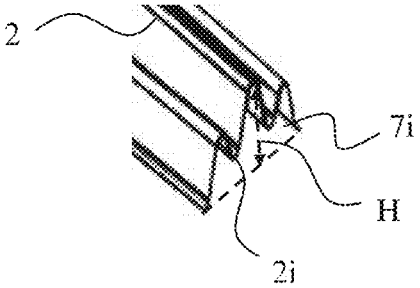

FIGS. 5, 6, 7 and 8 show another exemplary embodiment according to the invention for structures which have varying channel cross-sectional areas over the course thereof while having a constant perimeter length of a cross section. FIGS. 5 and 6 each show the same part of a structured sheet-metal layer 2 but in different viewing directions. FIGS. 7 and 8 show, on an enlarged scale, the two ends of the structures shown in FIGS. 5 and 6. In this case, the structured sheet-metal layer 2 has channels which have a relatively small inner channel cross-sectional area 7*i* and a relatively large outer channel cross-sectional area 7*a*. This is achieved by way of a flank corrugation which, as an inner flank corrugation 2*i*, has corrugation peaks and corrugation troughs running relatively close together, whereas an outer flank corrugation 2*a* is drawn out to a great extent in such a way that the corrugation troughs and corrugation peaks run in an almost flat manner. The structure height H of the structured sheet-metal layer 2 is, however, the same at both ends of the channels.

Figure 3:
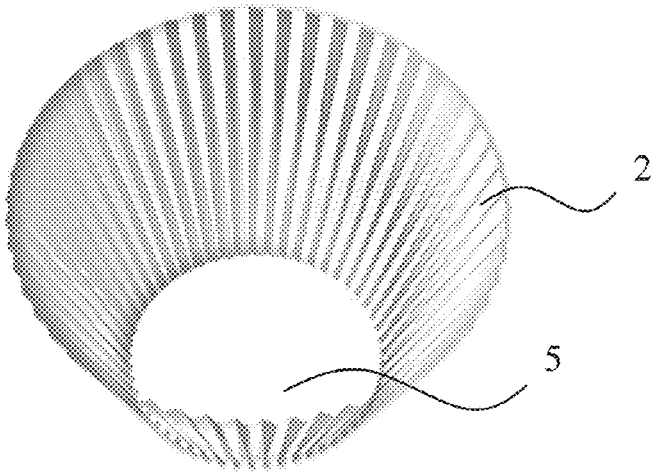
FIG. 3 is a perspective view of a structured sheet metal layer.

In the following figures, for simplicity, the illustrations show not funnel-shaped, conical layers but flat structures on which the details of the invention can be seen more clearly. In accordance with the present invention, however, it is the intention for the layers to also be funnel-shaped, as illustrated in FIGS. 1 and 3, in addition to the characteristics illustrated and described herein. It is, however, pointed out that the embodiments and production methods described in FIGS. 9-18 are basically also suitable for the production of honeycomb bodies with channels running purely radially, as is readily apparent from the illustrations. Such configurations can also partially achieve the stated objects, in a manner according to the invention.

Figure 9:
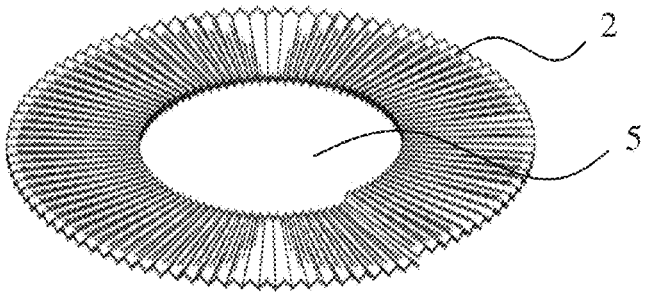
FIG. 9 is a perspective view of a helically structured sheet-metal layer.
Figure 10:
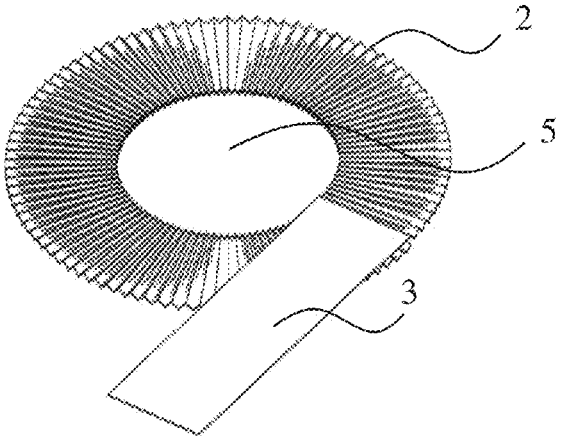
FIG. 10 is a perspective view of the sheet-metal layer of FIG. 9 with an intermediate layer.
Figure 11:
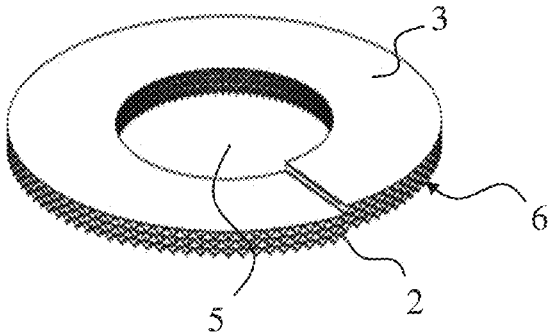
FIG. 11 is a perspective view of a sub-region of a honeycomb body composed of a structured sheet-metal layer and a smooth intermediate layer.

FIGS. 9, 10 and 11 illustrate how a structured sheet-metal layer 2 can be wound or stacked with the aid of a smooth intermediate layer 3 to form a helical structure, wherein the intermediate layer 3 prevents the structures of the structured sheet-metal layer 2 from sliding into one another during the layering process. In this case, FIG. 11 illustrates a sub-region of a honeycomb body thus formed, having a cavity 5 and an outer lateral surface 6, in which the helical configuration of the structured sheet-metal layer 2 and the intermediate layer 3 can be seen. In the illustration, only the additional funnel-shaped form has been omitted. This is, however, intended to be provided according to the invention, but has been flattened in the illustration for improved clarity.

Figure 12:
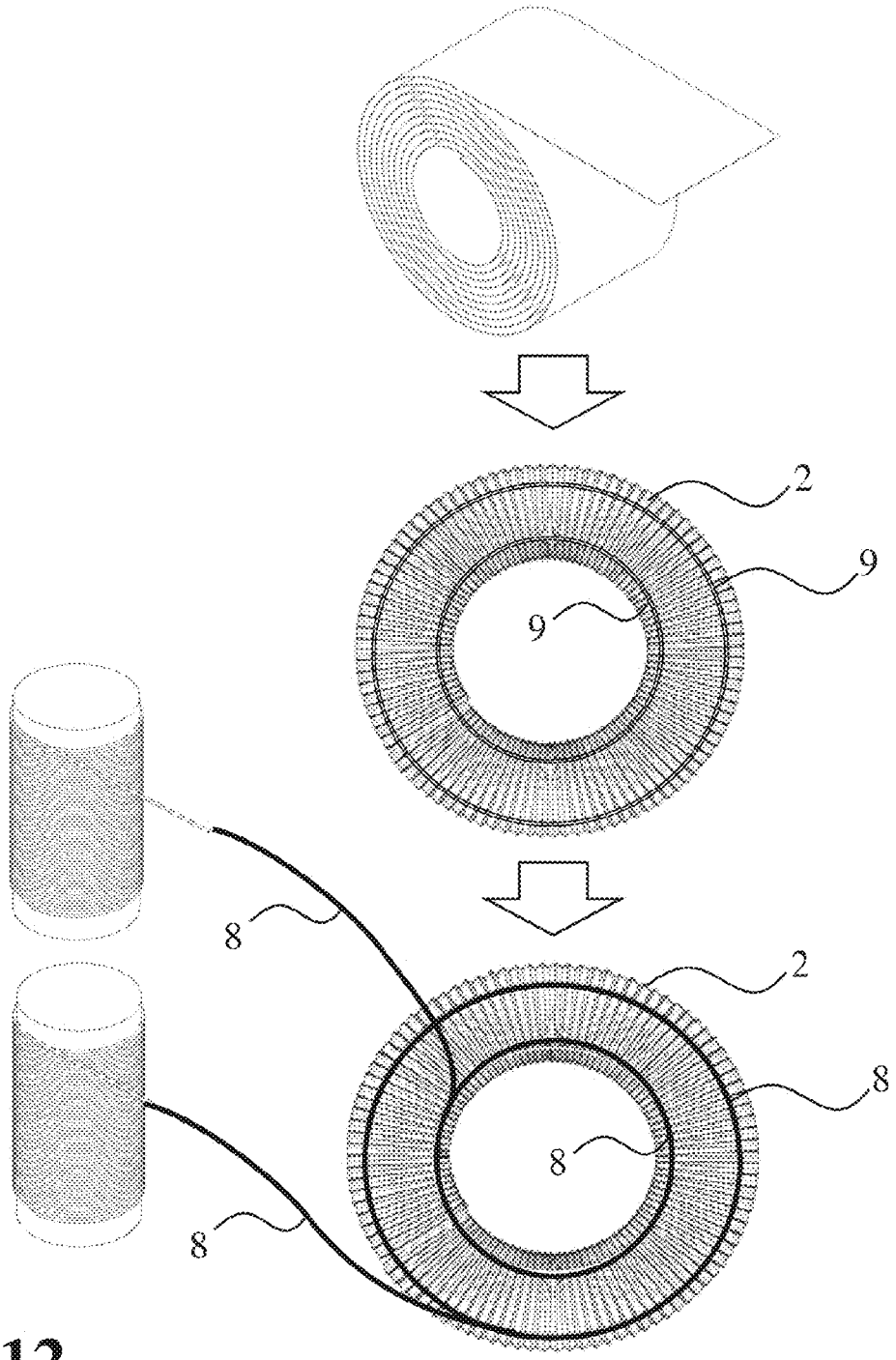
FIG. 12 is a perspective and elevational view showing a process of producing a honeycomb body using wires as an intermediate layer.
Figure 13:
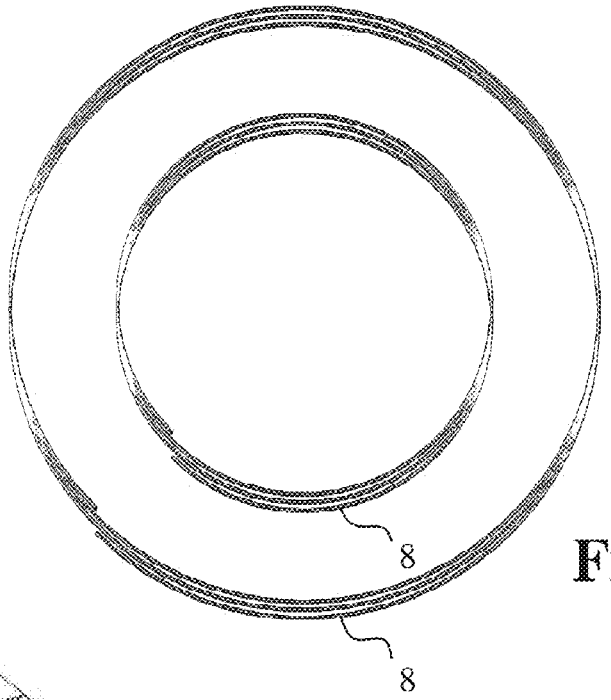
FIG. 13 is a perspective view showing forms of the wire, that form the intermediate layer, generated during the production process of FIG. 12.

FIG. 12 shows another exemplary embodiment of the invention in which the intermediate layer is formed by two wires 8, which preferably have a thickness of 0.1 to 1 mm. As is diagrammatically indicated, a helically structured sheet-metal layer 2 is formed from a smooth sheet-metal band, normally wound in the form of a so-called coil, by way of a suitable corrugation process, wherein inlay grooves 9 may be provided in the inner and outer region during the structuring process. During the helical layering process, in each case one wire 8 from a diagrammatically indicated storage roll is laid into the inlay grooves 9, in such a way that the two wires 8 form an intermediate layer, as long as the inlay groove 9 is not deeper than the thickness of the wires 8. In this case, the wires 8, which must be thin in relation to the structure height H of the structured sheet-metal layer 2, have the effect that the structured sheet-metal layers layered one on top of the other cannot slide into one another. This configuration has the additional advantage that larger channel cross sections are formed, because the channels are not delimited by a continuous intermediate layer.

FIG. 13 illustrates once again the forms of the wires 8 generated during the production process according to FIG. 12, in which the wires in turn run in a helical fashion in the completed honeycomb body.

Figure 14:
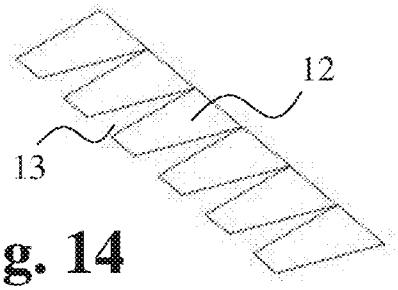
FIG. 14 is a perspective view of a smooth intermediate layer with triangular cutouts.
Figure 15:
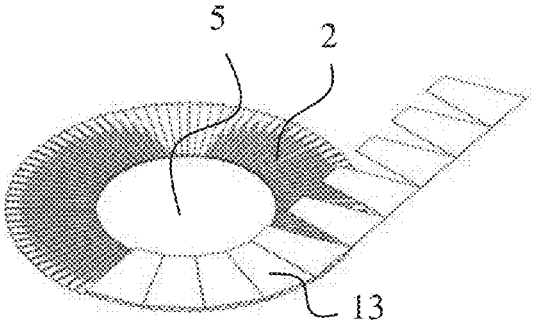
FIG. 15 is a perspective view showing the construction of a honeycomb body with a cutout smooth intermediate layer.
Figure 16:
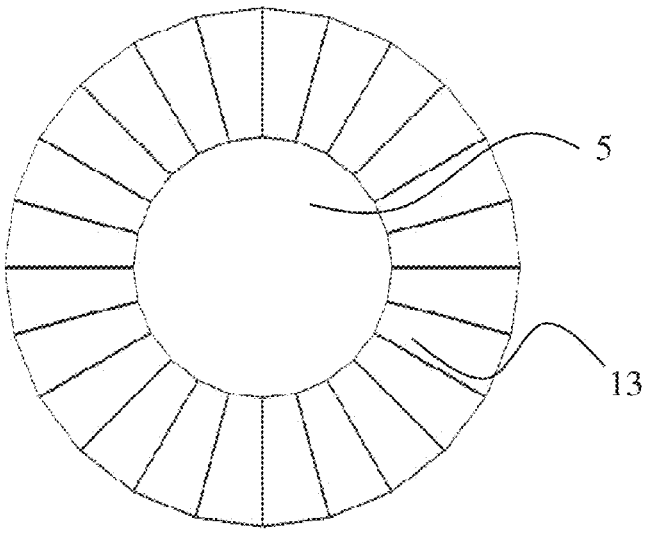
FIG. 16 is a plan view showing the final form of the cutout smooth intermediate layer after installation.

FIG. 14 illustrates another smooth intermediate layer 13, cut out in accordance with the invention, in which approximately triangular cutouts 12 are provided, in such a way that deformation to form a helical intermediate layer is easily possible. This is illustrated in FIG. 15, in which the cut-out smooth intermediate layer 13 has already partly been brought into its final form. It can be seen that the triangular cutouts 12 are specifically dimensioned in such a way that, in the finished state, a practically closed intermediate layer 13 is formed, which in turn serves to fully prevent structures of the structured sheet-metal layers 2 from sliding into one another. In the case of this production method, however, material waste is produced in the form of the triangular cutouts 12. In exchange, however, as illustrated once again in FIG. 16, a practically closed helical, cut-out, smooth intermediate layer 13 is formed, the individual segments of which are coherent at the outside and, at the inside, leave the cavity 5 free.

Figure 17:
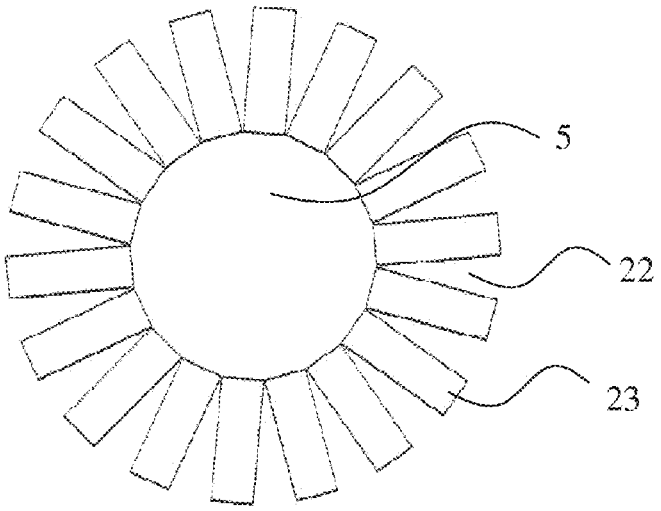
FIG. 17 is a plan view showing a slotted smooth intermediate layer in its final form.

An alternative embodiment is shown in FIG. 17, which illustrates a slotted smooth intermediate layer 23. In this case, slots run outward from a coherent region surrounding the cavity 5, in such a way that no waste material is produced, but triangular slots that open from the inside outward are provided. It is nevertheless possible for a slotted smooth intermediate layer 23 of this type to substantially prevent structures of adjacent structured sheet-metal layers from sliding into one another.

Figure 18:
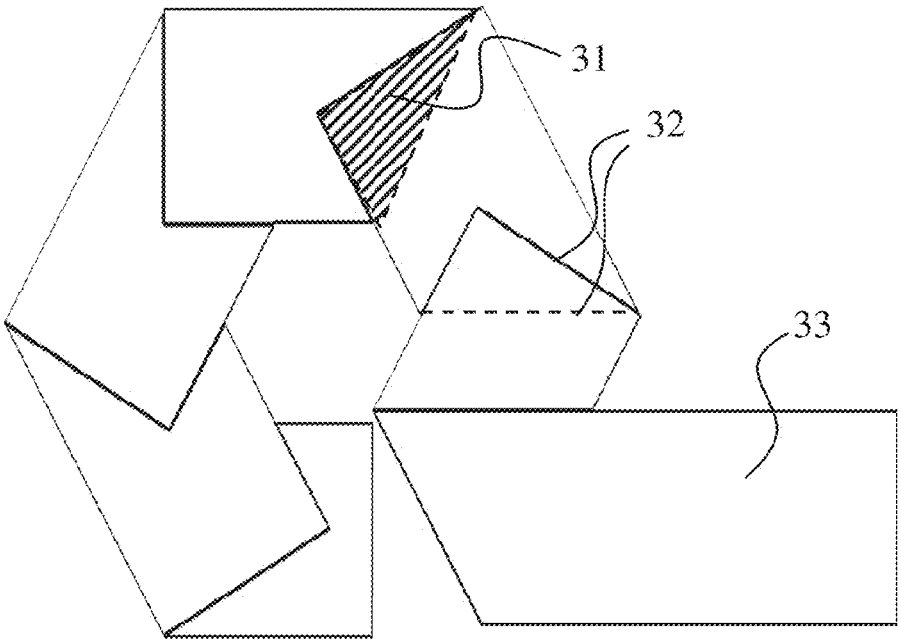
FIG. 18 is a perspective view showing a folded smooth intermediate layer, partially in its final form.

A further form of a folded smooth intermediate layer 33 is illustrated in FIG. 18. Since sheet-metal layers with a thickness of 20 μm to 120 μm are typically used in honeycomb bodies, it is not of great significance for the final form if sheet-metal layers overlap in individual regions. This fact is utilized in the embodiment according to FIG. 18, in which the intermediate layer 33 is folded along fold lines 32, so that approximately triangular shapes are generated in an overlap region 31. In this way, depending on the number of fold lines 32, it is possible to produce the desired form of an intermediate layer from a smooth sheet-metal strip in helical form or in helical and funnel-shaped form in a highly effective manner.

It is thus possible for honeycomb bodies according to the invention to be mass-produced from sheet-metal strips by helically layering structured sheet-metal layers 2 and intermediate layers 3.

Figure 19:
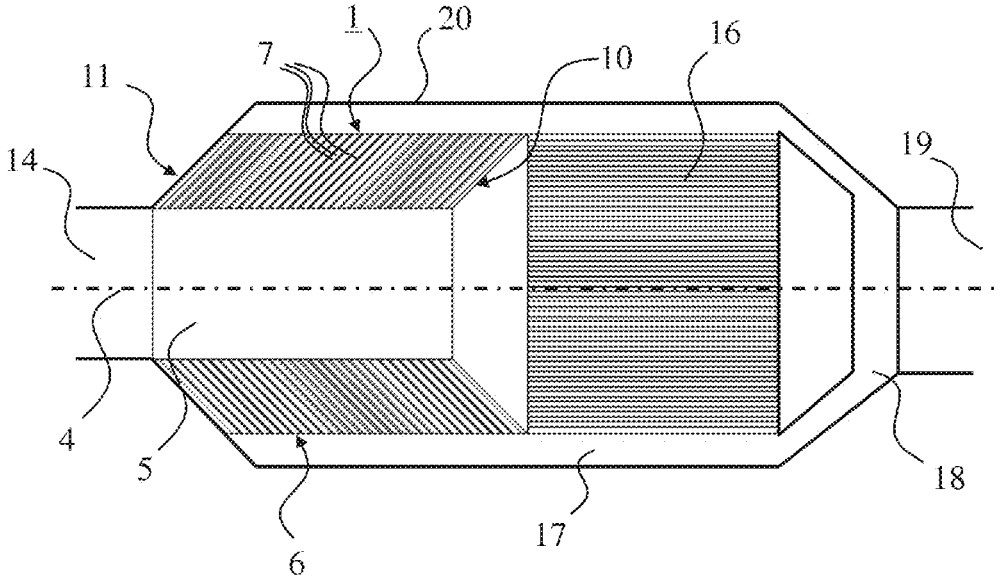
FIG. 19 is a perspective view showing a combined configuration of a honeycomb body with a cylindrical honeycomb body.

FIG. 19 illustrates how a honeycomb body 1 according to the invention can be disposed with a conventional cylindrical honeycomb body 16 in a common housing 20. A fluid to be purified, in particular exhaust gas of an internal combustion engine, can flow from an inlet 14 into the cavity 5 of the conical honeycomb body 1 according to the invention, wherein a part of the fluid passes through channels 7 to the outer lateral surface 6. This part of the fluid is collected in a collecting chamber 17, is conducted around the outside of the cylindrical honeycomb body 16, and then passes into a mixing chamber 18 and to an outlet 19. Another part of the fluid flows from the cavity 5 into the cylindrical honeycomb body 16 which includes partially illustrated axial channels, in such a way that this part of the fluid also passes into the mixing chamber 18 and to the outlet 19. It is particularly advantageous for the conical honeycomb body 1 and the cylindrical honeycomb body 16 to be disposed in alignment along a common geometric central axis 4. This embodiment is an example for possible uses of conical honeycomb bodies for the expedient utilization of existing structural space and for the reduction of pressure losses while providing a predefined surface area for catalytic conversion or for separating off particles.

Altogether, the invention permits flexible use, in a manner adapted to different installation situations, of conical honeycomb bodies on their own or in conjunction with other honeycomb bodies for the treatment of fluids, in particular for the purification of exhaust gases of internal combustion engines, in particular in motor vehicles.

The invention claimed is:

1. A honeycomb body, comprising:

an inside, an outside and a geometric central axis;

wound layers each running concentrically around said central axis and defining an outer lateral surface and a cavity disposed rotationally symmetrically around said central axis, said layers being sheet-metal layers;

at least one of said layers being at least partially structured to form a multiplicity of channels through which a fluid can flow;

said channels running outwardly from said cavity to said outer lateral surface at a non-perpendicular cone angle relative to said central axis;

said channels having a channel cross section varying over a course of said channels from said inside to said outside;

at least one intermediate layer being disposed in alternation with said at least one structured layer; and said at least one intermediate layer and said at least one structured layer being layered on top of one other in a helical shape;

said at least one at least partially structured sheet-metal layer having a structure defined by individual corrugations each having respective opposing flanks, each of said opposing flanks having a respective flank corrugation for defining an approximately constant structure height of said individual corrugations from said inside to said outside.

2. The honeycomb body according to claim 1, wherein at least said cavity or said lateral surface is cylindrical.

3. The honeycomb body according to claim 1, wherein said cone angle relative to said central axis is 25° to 85° .

4. The honeycomb body according to claim 1, wherein said channels have a constant structure height, and said channels have cross-sectional areas increasing from said inside to said outside.

5. The honeycomb body according to claim 1, wherein said cavity is axially offset relative to said lateral surface, forming a first conical side face and a second hollow conical side face.

6. The honeycomb body according to claim 1, wherein said intermediate layer has slots formed therein so as to extend inward from said outer lateral surface along a profile of said channels.

7. The honeycomb body according to claim 1, wherein said intermediate layer has triangular cutouts formed therein being dimensioned to cause said intermediate layer, after being bent into a final helical shape, to form a closed intermediate layer.

8. The honeycomb body according to claim 1, wherein said intermediate layer is folded along fold lines to generate overlaps with a threefold material thickness and to form a helical profile of said intermediate layer.

9. A honeycomb body assembly, comprising:

a cylindrical honeycomb body through which a fluid can flow along a geometric central axis; and a honeycomb body according to claim 1 combined with said cylindrical honeycomb body.

10. The honeycomb body assembly according to claim 9, which further comprises a housing in which said honeycomb bodies are disposed with said geometric central axes aligned.

11. A honeycomb body, comprising:

an inside, an outside and a geometric central axis;

wound or stacked layers each running concentrically around said central axis and defining an outer lateral surface and a cavity disposed rotationally symmetrically around said central axis;

at least one of said layers being at least partially structured to form a multiplicity of channels through which a fluid can flow;

said channels running outwardly from said cavity to said outer lateral surface at a non-perpendicular cone angle relative to said central axis;

said channels having a channel cross section varying over a course of said channels from said inside to said outside;

at least one intermediate layer being disposed in alternation with said at least one structured layer; and said at least one intermediate layer and said at least one structured layer being layered on top of one other in a helical manner;

all of said layers being structured sheet-metal layers including alternating structured sheet-metal layers with a coarse structure and intermediate layers with a fine structure, said coarse and fine structures having dimensions differing by at least a factor of 3.

12. A honeycomb body, comprising:

an inside, an outside and a geometric central axis;

wound or stacked layers each running concentrically around said central axis and defining an outer lateral surface and a cavity disposed rotationally symmetrically around said central axis;

at least one of said layers being at least partially structured to form a multiplicity of channels through which a fluid can flow;

said channels running outwardly from said cavity to said outer lateral surface at a non-perpendicular cone angle relative to said central axis;

said channels having a channel cross section varying over a course of said channels from said inside to said outside;

at least one intermediate layer being disposed in alternation with said at least one structured layer; and said at least one intermediate layer and said at least one structured layer being layered on top of one other in a helical manner said layers being sheet-metal layers, and said intermediate layer being at least one wire running in a helical manner between said structured sheet-metal layers.

* * * * *